US007857086B2

(12) United States Patent
Wakuta et al.

(10) Patent No.: US 7,857,086 B2
(45) Date of Patent: Dec. 28, 2010

(54) WORKING VEHICLE

(75) Inventors: Kensaku Wakuta, Osaka (JP); Kazuhiko Miyamoto, Osaka (JP); Masahiro Hanafusa, Osaka (JP); Junko Shibaoka, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 259 days.

(21) Appl. No.: 12/284,059

(22) Filed: Sep. 18, 2008

(65) Prior Publication Data

US 2009/0313862 A1 Dec. 24, 2009

Related U.S. Application Data

(63) Continuation-in-part of application No. 12/214,956, filed on Jun. 24, 2008, now Pat. No. 7,757,805.

(51) Int. Cl.
*B60K 28/04* (2006.01)

(52) U.S. Cl. ..... 180/273; 307/10.1; 701/50; 200/85 A; 180/326

(58) Field of Classification Search ..... 180/273, 180/326, 330, 331, 321, 324; 200/85 A; 701/50; 307/10.1
See application file for complete search history.

(56) References Cited

U.S. PATENT DOCUMENTS

| | | | | |
|---|---|---|---|---|
| 4,699,561 | A * | 10/1987 | Tee | 414/699 |
| 5,092,408 | A * | 3/1992 | Tatara et al. | 172/2 |
| 6,226,902 | B1 * | 5/2001 | Heyne | 37/348 |
| 6,430,850 | B1 * | 8/2002 | VanDerZyl et al. | 37/410 |
| 6,643,577 | B1 * | 11/2003 | Padgett et al. | 701/50 |
| 6,694,240 | B1 * | 2/2004 | Swick et al. | 701/50 |
| 7,283,903 | B2 * | 10/2007 | Merten et al. | 701/50 |
| 7,337,866 | B2 * | 3/2008 | Nishi et al. | 180/273 |
| 7,681,686 | B1 * | 3/2010 | Klas et al. | 180/331 |
| 2006/0037805 | A1 * | 2/2006 | Muraro | 180/321 |
| 2009/0012679 | A1 * | 1/2009 | Prasetiawan et al. | 701/50 |

FOREIGN PATENT DOCUMENTS

| | | |
|---|---|---|
| JP | 2005-069113 | 3/2005 |
| JP | 2007-277849 | 10/2007 |
| JP | 2008-031787 | 2/2008 |
| JP | 2008-137465 | 6/2008 |

* cited by examiner

*Primary Examiner*—Ruth Ilan
(74) *Attorney, Agent, or Firm*—Jordan and Hamburg LLP

(57) ABSTRACT

A working vehicle in accordance with the present invention is provided with an engine mounted on a front portion of a vehicle body frame constructing a traveling vehicle body, a backhoe arranged on a rear portion of the vehicle body frame, a mower device arranged below the vehicle frame, a seating detecting means detecting a seating of an operator in a control seat on the traveling vehicle body, an engine stop mechanism stopping the engine, and a shift control means for controlling so as to increase and decrease forward and backward moving speeds of the traveling vehicle body. Further, in consideration for a safety at a time of an excavating work by the backhoe, the structure is made such that the engine stop mechanism is actuated at a time of operating the shift control means in the case that the seating detecting means is in an on state, and the seating detecting means is retained to the on state regardless of the seating of an operator in the case that the control seat is directed backward.

3 Claims, 16 Drawing Sheets

WORKING VEHICLE

BACKGROUND OF THE INVENTION

The present invention relates to a working vehicle, for example, a tractor front loader backhoe (hereinafter, refer to as TLB).

In the TLB serving as the working vehicle, a front loader is installed to a front portion of a traveling vehicle body, and a backhoe is arranged on a rear portion. In the TLB having the structure mentioned above, in the case of carrying out an excavating work by the backhoe, a control seat on the traveling vehicle body is directed backward, and the backhoe is operated in a state of seating on the backward-looking control seat.

In the conventional TLB, for example, in the case of seating on the backward-looking control seat, for example, if a shift control means such as an accelerator pedal or the like is erroneously operated, there is a risk that the TLB travels forward as it is, so that it is lacking in safety at a time of an excavating work by the backhoe.

Accordingly, in the invention described in Japanese Unexamined Patent Publication No. 2005-69113, there has been proposed a structure forcibly stopping an engine even in the case of erroneously operating a shift control means in a state in which a control seat is directed backward, while maintaining a basic function of forcibly stopping the engine if the shift control means is erroneously operated in a state in which an operator does not seat on the forward-looking control seat, by providing two kinds of detecting means such as a seating sensor detecting whether or not the operator seats on the control seat, and a rotation detecting switch detecting a forward or backward direction (a rotation) of the control seat, in consideration for a safety at a time of the excavating work by the backhoe.

However, in the structure described in Japanese Unexamined Patent Publication No. 2005-69113, since two kinds of detecting means including the seating sensor and the rotation detecting switch are necessary, a parts cost is increased, an electric system such as an electric circuit, a harness or the like is complicated, and a working man hour for a wiring work is increased, so that there is a problem that it does not meet a demand for a cost reduction which has been increased in recent years.

SUMMARY OF THE INVENTION

The present invention is made by taking the actual condition mentioned above into consideration. In accordance with the present invention, there is provided a working vehicle comprising: an engine mounted on a front portion of a vehicle body frame constructing a traveling vehicle body; a backhoe arranged on a rear portion of the vehicle body frame; a seating detecting means detecting a seating of an operator in a control seat on the traveling vehicle body; an engine stop mechanism stopping the engine; and a shift control means for controlling so as to increase and decrease forward and backward moving speeds of the traveling vehicle body.

Further, the structure is made such that the engine stop mechanism is actuated at a time of operating the shift control means in the case that the seating detecting means is in an on state, and the seating detecting means is retained to the on state regardless of the seating of an operator in the case that the control seat is directed backward.

In accordance with the structure mentioned above, since the seating detecting means is retained in the on state at a time of an excavating work by the backhoe which is carried out by directing the control seat backward, it is possible to forcibly stop the engine by erroneously controlling the shift control means in a state in which the operator does not seat on the forward-looking control seat, in spite that the seating detecting means is only provided as a means for detecting a state of the control seat.

Further, it is possible to forcibly stop the engine even at a time of operating the shift control means in a state in which the control seat is directed backward, while maintaining the basic function mentioned above. Accordingly, it is possible to securely prevent a risk that the working vehicle carelessly begins to run at a time of the excavating work by the backhoe, and it is possible to achieve an effect that a safety is improved.

Further, since the seating detecting means is only provided as the means for detecting the state of the control seat, and any means for detecting forward and backward directions of the control seat is not necessary, it is possible to suppress a parts cost, and it is possible to simplify the electric system such as the electric circuit, the harness or the like. Accordingly, it is possible to achieve an effect that the reduction of the manufacturing cost can be obtained.

DESCRIPTION OF THE PREFERRED EMBODIMENTS

Figure 1:
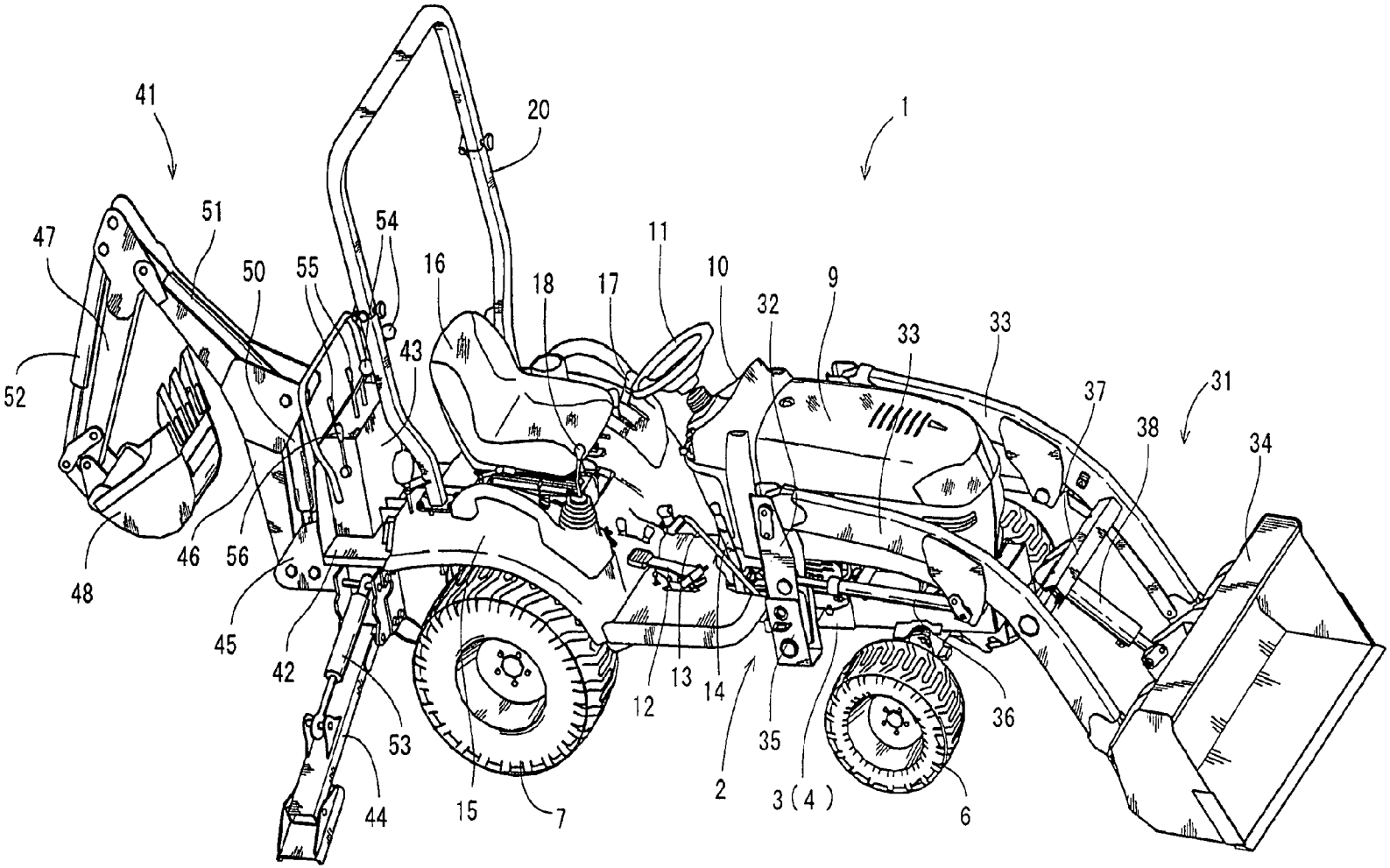
FIG. 1 is a perspective view of a whole of a TLB.

A description will be given of an embodiment in which the present invention is applied to a TLB serving as a working vehicle with reference to the accompanying drawings (FIGS. 1 to 16). In the following description, a left side in the direction of a forward moving direction of the TLB 1 is called simply as a left side, and a right side in the direction of the forward moving direction is called simply as a right side in the same manner. Further, FIG. 1 omits an illustration of a mower device.

(1) Outline of TLB

First, a description will be given of a whole outline of the TLB 1 mainly with reference to FIGS. 1 to 4.

A traveling vehicle body 2 of the TLB 1 is provided with a vehicle body frame 3 (see FIGS. 5 and 6) including a pair of right and left main frames 4 which extend longitudinally, and a plurality of horizontal frames 5 which extend laterally, in a ladder shape. The vehicle body frame 3 is supported by right and left front wheels 6 and right and left rear wheels 7 serving as a traveling portion and mounted on front and rear sides in both right and left sides. An engine 8 serving as a power source is mounted on a front portion of the vehicle body frame 3. The TLB 1 is structured such as to travel forward and backward by driving the front wheels 6 and the rear wheels 7 by the engine 8. The engine 8 is covered by a hood 9.

A control column portion 10 having a control handle 11 is mounted on a rear portion of an upper surface of the hood 9. In this case, if the control handle 11 is rotationally operated, the structure is made such that a steering angle of both the right and left front wheels 6 is changed in correspondence to an operating amount (a rotating amount). In a lower side of the control column portion 10, there are arranged a shift pedal 12 serving as a shift control means for operating so as to increase and decrease a forward and backward moving speed of the traveling vehicle 2, a brake lever 13 for operating so as to brake both the right and left rear wheels 7, and a parking brake lever 14 serving as a parking brake operating means carrying out an operation for retaining a braked state of both the right and left rear wheels 7.

A control seat 16 structured such as to be capable of changing the direction forward and backward is provided on a rear cowl 15 covering a rear portion of the upper surface of the traveling vehicle body 2. In a left side of the control seat 16, there is arranged a PTO lever 17 or the like serving as a PTO operating means operating so as to maintain and intermit a power transmission from a transmission case 21 mentioned below to a mower device 25 mentioned below. In a right side of the control seat 16, there are arranged a loader lever 18 for operating a front loader 31 mentioned below, an accelerator lever 19 for increasing and decreasing a rotating speed of the engine 8, and the like. A rear side of the control seat 16 is provided with a lops frame 20 for protecting an operator at a time when the traveling vehicle body 2 is inverted.

Although the details will be mentioned later, the transmission case 21 for appropriately shifting the power from the engine 5 so as to transmit the power to the front wheels 6 and the rear wheels 7 is mounted on a rear portion of the vehicle body frame 3. A rear axle case 22 is installed to both right and left side portions of the transmission case 21 in such a manner as to protrude to right and left outer sides. The right and left rear wheels 7 are rotatably attached to right and left leading end sides in the rear axle case 22. In this embodiment, the control seat 16 is positioned in an upper side of the transmission case 21.

Figure 2:
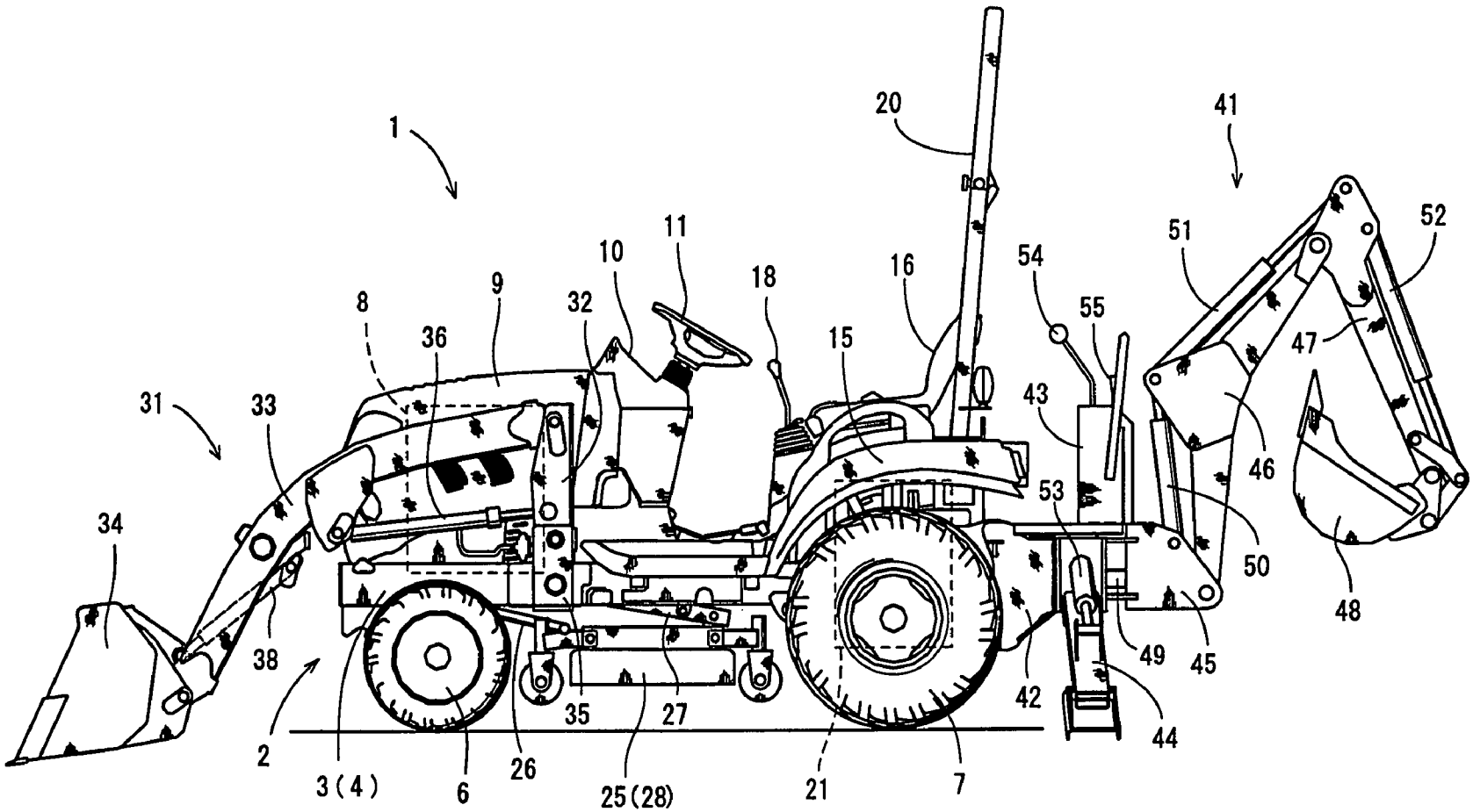
FIG. 2 is a left side view of the TLB.
Figure 3:
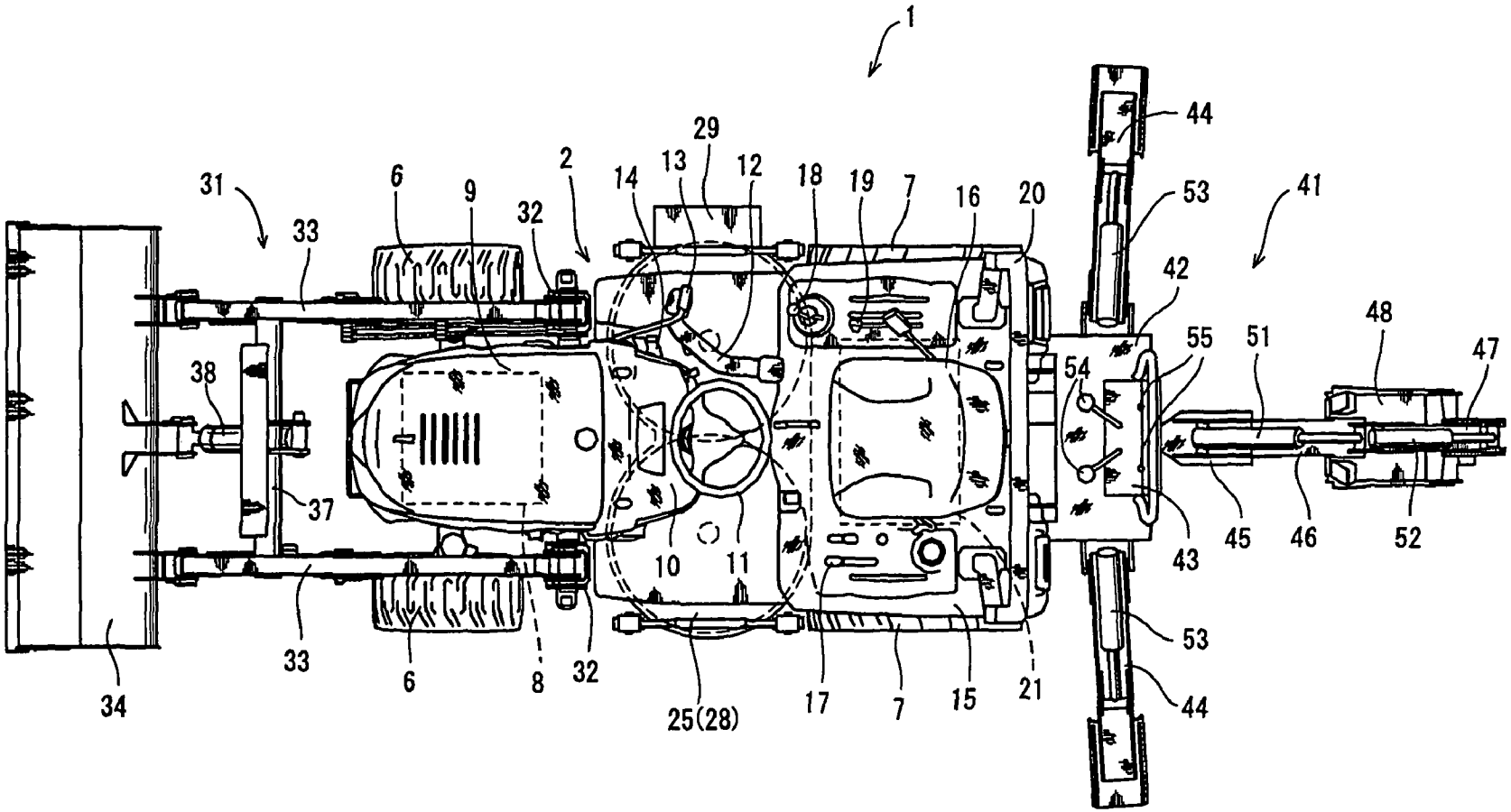
FIG. 3 is a plan view of the TLB.
Figure 4:
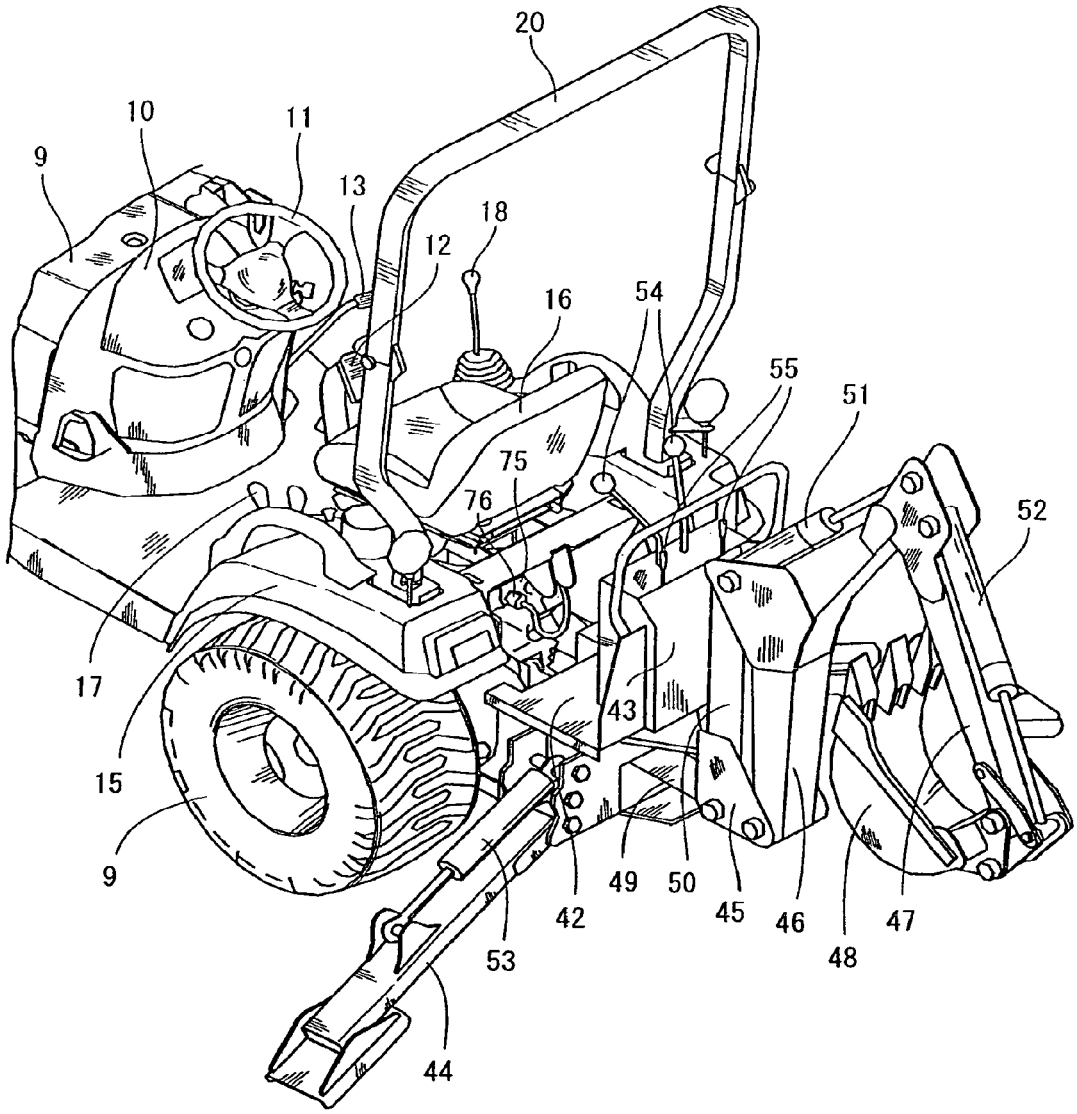
FIG. 4 is an enlarged perspective view of a rear portion in the case of viewing the TLB from a left oblique rear side.
Figure 5:
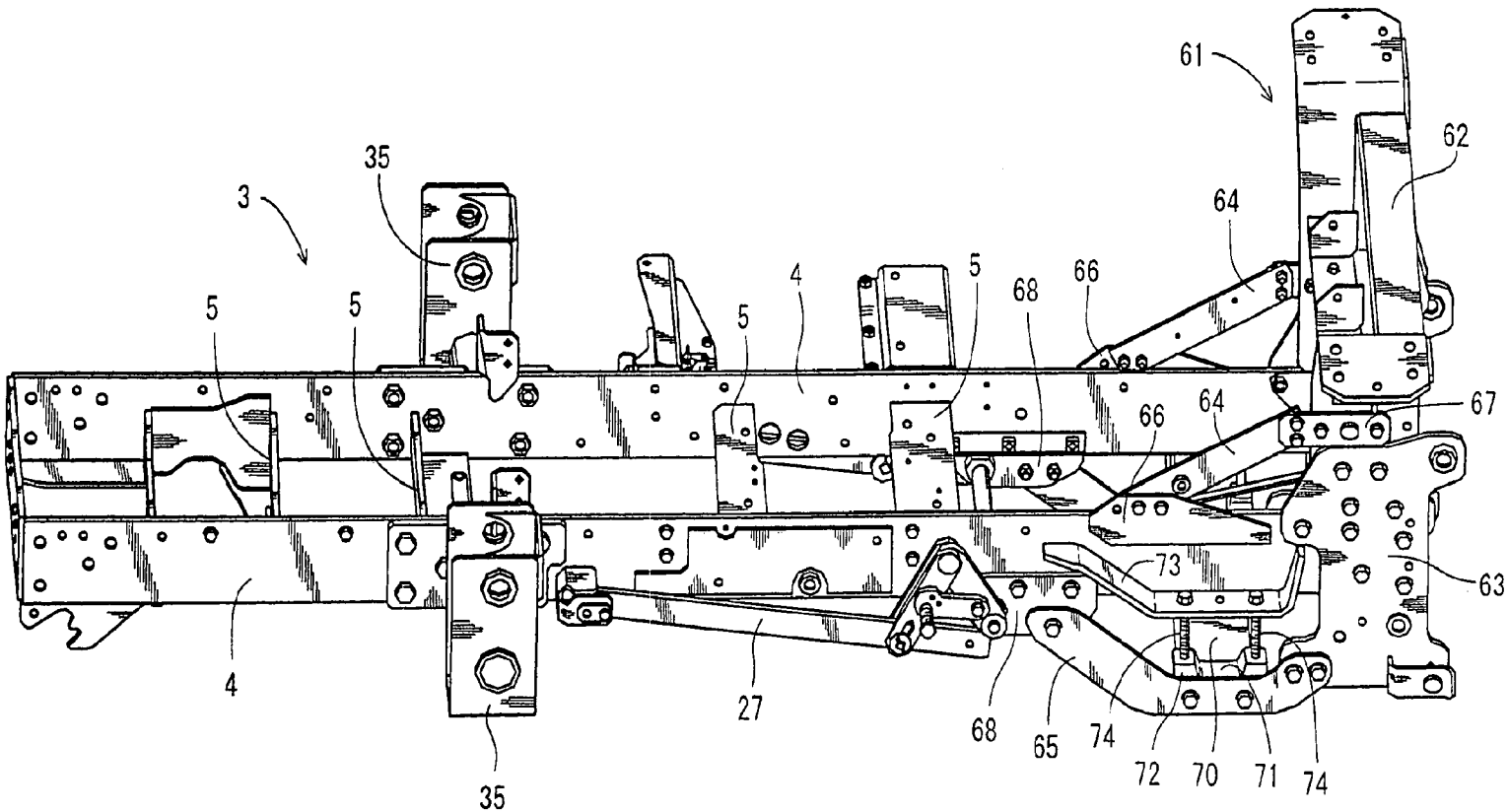
FIG. 5 is a perspective view in the case of viewing a vehicle body frame from a left oblique upper side.
Figure 6:
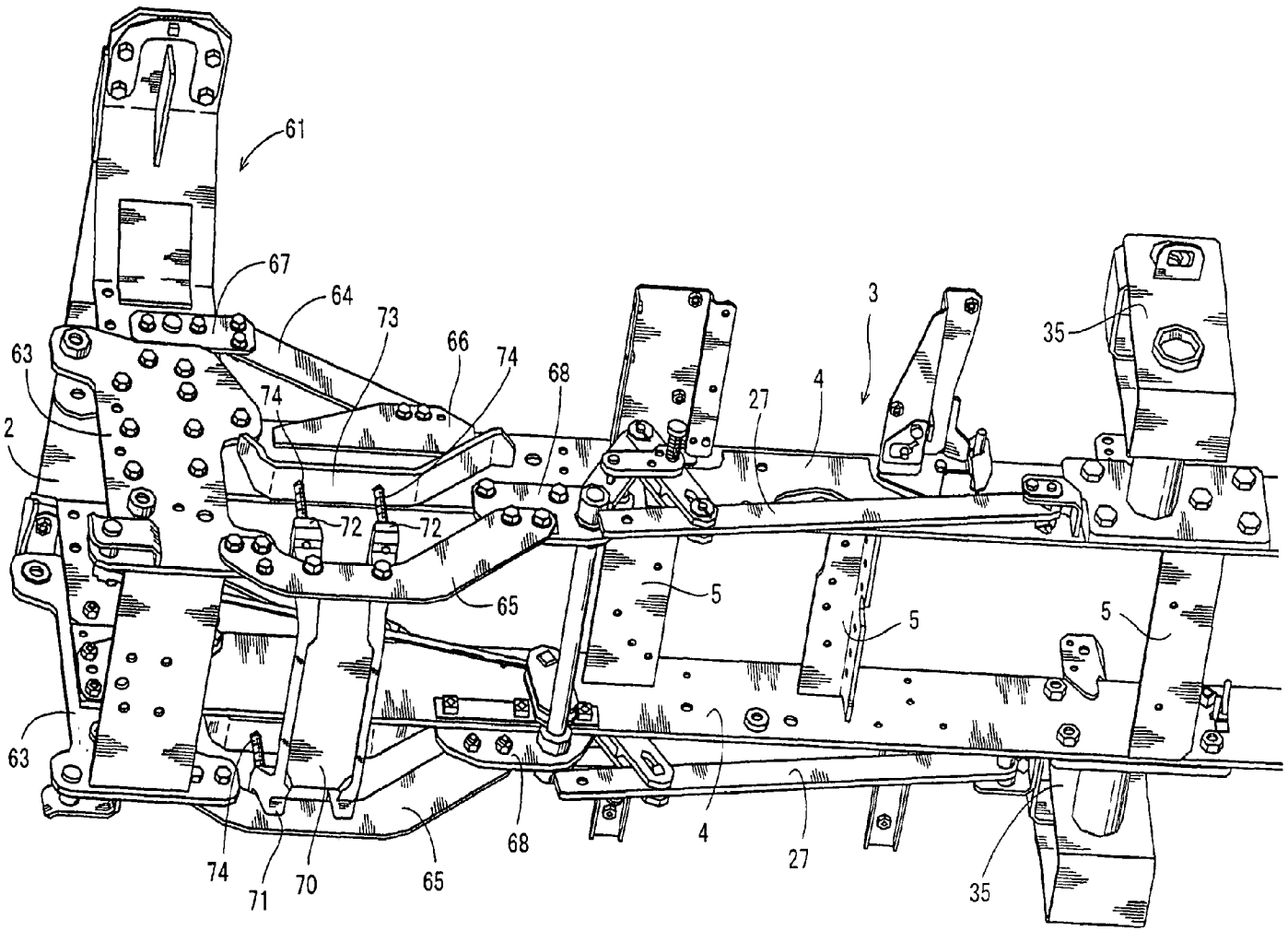
FIG. 6 is a perspective view in the case of viewing the vehicle body frame from a right oblique lower side.

The mower device 25 for mowing a lawn is installed between the front wheels 6 and the rear wheels 7 in a lower portion of the traveling vehicle body 2 so as to be movable up and down and rotatable via a pair of front and rear link levers 26 and 27 (see FIGS. 2, 5 and 6). The mower device 25 is provided with a pair of horizontally rotatable rotary mowing blades (not shown) within a mower case 28 formed as a downward open bowl shape. A discharge duct 29 for discharging the mowed lawn is formed in a horizontal one side portion of the mower case 28 so as to be open outward. The mowed lawn mowed by the rotary mowing blades is discharged to a horizontal side of the traveling vehicle body 2 from the discharge duct 29 by utilizing a carrier wind generated by the rotation of the rotary mowing blade.

The front loader 31 is provided in a front portion of the traveling vehicle body 2. The front loader 31 has loader posts 32 mounted on both right and left sides while disposing the hood 9 therebetween, a pair of right and left lift arms 33 coupled to upper ends of the respective loader posts 32 so as to be capable of oscillating up and down, and a bucket 34 coupled to leading end portions of both the lift arms 33 so as to be capable of oscillating up and down.

Each of the right and left loader posts 32 is provided in a rising manner in a post support member 35 protruded outward right and left from a longitudinal middle portion of each of the main frames 4 in the vehicle body frame 3. A lift cylinder 36 for oscillating the lift arm 33 up and down is provided between each of the loader posts 32 and the corresponding lift arm 33. A bucket cylinder 38 for oscillating the bucket 34 up and down is provided between a horizontal frame 37 connecting between the longitudinal middle portions of both the lift arms 33 and the bucket 34.

In this case, both the lift arms 33 and the bucket 34 are oscillated up and down by operating so as to expand and contract both the lift cylinders 36 and the bucket cylinder 38 in accordance with an operation of the loader lever 18 provided in a right side of the control seat 16. The operation of the loader lever 18 can be carried out in a state of seating on the forward-looking control seat 16.

A backhoe 41 is provided in a rear portion of the traveling vehicle body 2. The backhoe 41 has a base plate 42 including a control portion 43, an outrigger 44, and the like, a swing bracket 45 coupled to the base plate 42 so as to freely oscillate laterally, a boom 46 coupled to the swing bracket 45 so as to freely oscillate up and down, an arm 47 coupled to a leading end portion of the boom 46 so as to freely oscillate longitudinally, and a bucket 48 coupled to a leading end portion of the arm 47 so as to freely scoop and oscillate.

The base plate 42 is detachably installed to a backhoe support frame 61 (see FIGS. 5 and 6) provided in a rear end portion of the vehicle body frame 3. A swing cylinder 49 for oscillating the swing bracket 45 laterally is provided between the base plate 42 and the swing bracket 45. A boom cylinder 50 for oscillating the boom 46 up and down is provided between the swing bracket 45 and the longitudinal middle portion of the boom 46. An arm cylinder 51 for oscillating the arm 47 longitudinally is provided between the longitudinal middle portion of the boom 46 and a base end portion of the arm 47. A bucket cylinder 52 for scooping and oscillating the bucket 48 is provided between the base end portion of the arm 47 and the bucket 48.

The outrigger 44 provided in both the right and left side portions of the base plate 42 so as to be rotatable up and down is a structure for positioning and fixing the traveling vehicle body 2 at a time of an excavating work by the backhoe 41. A hydraulic cylinder 53 for rotating the outrigger 44 up and down is provided between the base plate 42 and the longitudinal middle portion of each of the outriggers 44.

The control portion 42 set in an upper surface of the base plate is provided with a pair of right and left backhoe levers 54 for operating the backhoe 41 so as to be activated up and down and right and left, a pair of right and left outrigger levers 55 for operating each of the outriggers 44 so as to rotate up and down, and a base plate side accelerator lever 56 for accelerating and decelerating the rotating speed of the engine 8 at a time of the excavating work by the hack hoe 41.

In this case, the swing bracket 45, the boom 46, the arm 47 and the bucket 48 are oscillated by actuating the swing cylinder 49, the boom cylinder 50, the arm cylinder 51, and the bucket cylinder 52 so as to expand and contract in accordance with the operation of the backhoe lever 54. Further, each of the right and left outriggers 44 is rotated up and down by actuating the corresponding hydraulic cylinder 53 so as to expand and contract, in accordance with the operation of each of the outrigger levers 55.

The operation of the various levers 54 to 56 provided in the control portion 42 is carried out in a state of rotating the control seat 16 at 180 degrees, and seating on the control seat 16 directed backward. In this case, the base plate side accelerator lever 56 is structured such as to function only at a time when the control seat 16 is directed backward. Further, the base plate side accelerator lever 56 may be provided in the traveling vehicle body 2 side (for example, at the lops frame 20 or the like).

(2) Attaching Structure of Transmission Case

Next, a description will be given of an attaching structure of the transmission case 21 mainly with reference to FIGS. 5 to 9.

As mentioned above, the vehicle body frame 3 is structured such that a pair of right and left main frames 4 which extend longitudinally and a plurality of horizontal frames 5 which extend laterally are coupled as a ladder shape. The rear end portion of the vehicle body frame 3 is provided with a backhoe support frame 61 to which the base plate 42 is installed. The backhoe support frame 61 in the embodiment is formed as a rectangular shape in a front view, and right and left side frame portions 63 of the backhoe support frame 61 are fastened by bolts to the rear end portion of the main frame 4 corresponding thereto.

The rear portion side of each of the main frames 4 and an upper portion side of the right and left side frame portions 63 in the backhoe support frame 61 are coupled by a long plate-shaped upper brace member 64. Further, the rear portion side of each of the main frames 4 and a lower portion side of the right and left side frame portion 63 in the backhoe support frame 61 are coupled by a curved plate-shaped lower brace member 65. These brace members 64 and 65 serve as a strength member for improving a coupling strength between the vehicle body frame 3 and the backhoe support frame 61.

In the embodiment, the leading end side of each of the upper brace members 64 is fastened by bolts to a first bracket 66 welded and fixed to an outer side surface of the rear portion of the corresponding main frame 4.

The base end side of each of the upper brace members 64 is fastened by bolts to a coupling bracket 67 fastened by bolts to an upper portion side of the corresponding right and left side frame portion 63. A leading end side of each of the lower brace members 65 is fastened by bolts to a second bracket 68 fastened by bolts to further forwardly than the first bracket 66 in the outer side surface of the rear portion of the corresponding main frame 4. A base end side of each of the lower brace members 65 is fastened by bolts to a lower end portion of the corresponding right and left side frame portion 63.

An approximately flat plate-shaped reinforcing plate 70 extending laterally is arranged between both the right and left lower brace members 65. Right and left end portions of the reinforcing plate 70 serves as a stepped portion 71 formed as a step shaped in a front view, and the stepped portion 71 is fastened by bolts to the corresponding lower brace member 65 (two positioned per each of right and left sides, totally four positions). Accordingly, the reinforcing plate 70 serves as a strength member for improving a coupling strength between both the lower brace members 65 and between the vehicle body frame 3 and the backhoe support frame 61. A leading end side of the stepped portion 71 serves as a protruding end portion 72 protruding to rightwardly and leftwardly relative to each of the lower brace members 65. On the other hand, a support bracket 73 protruding to right and left outer sides is welded and fixed to a lower position than the first bracket 66 in the outer side surface of the rear portion of each of the main frames 4.

Figure 7:
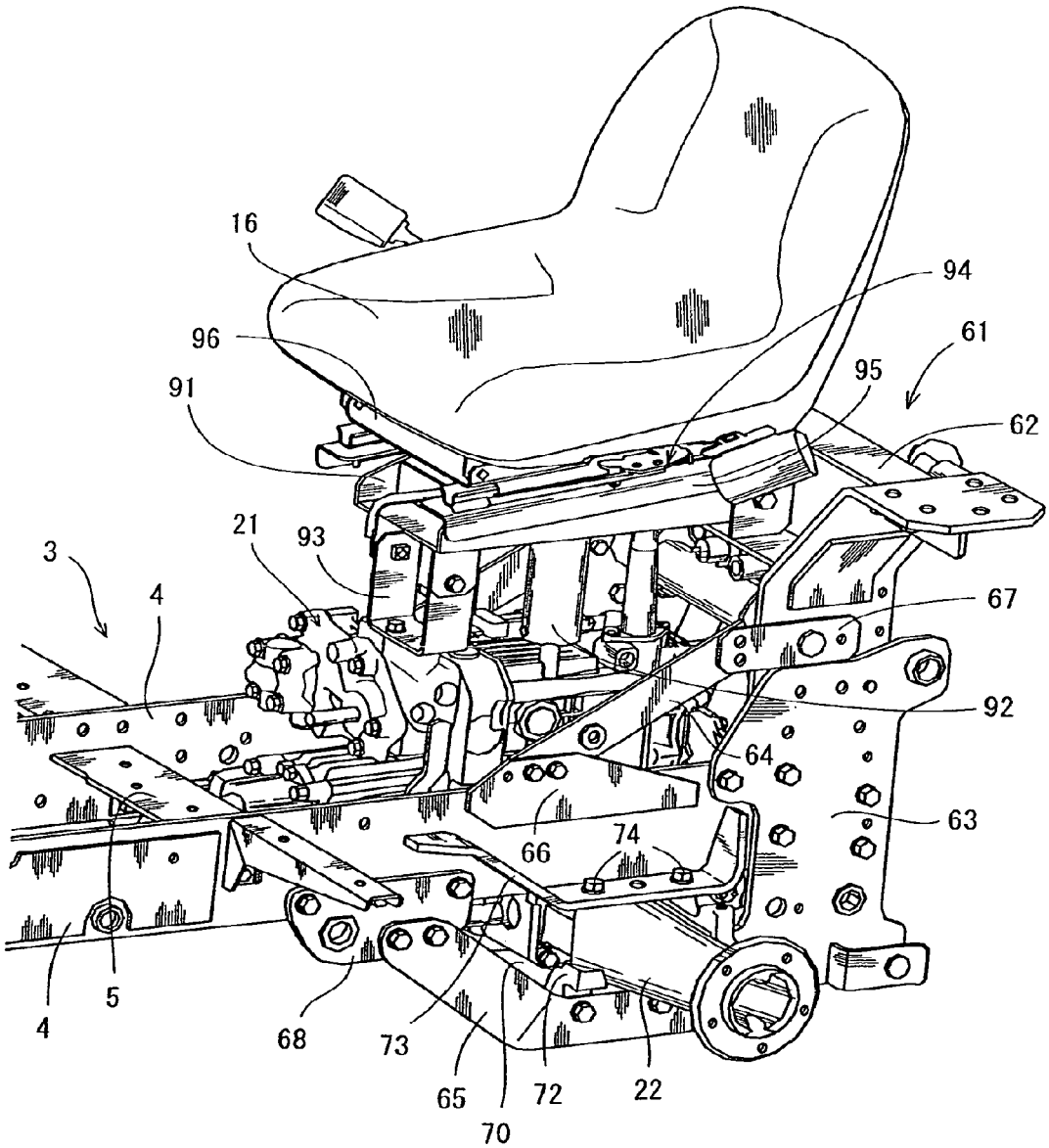
FIG. 7 is an enlarged perspective view in the case of viewing the vehicle body frame with a transmission case from a left oblique upper side.
Figure 8:
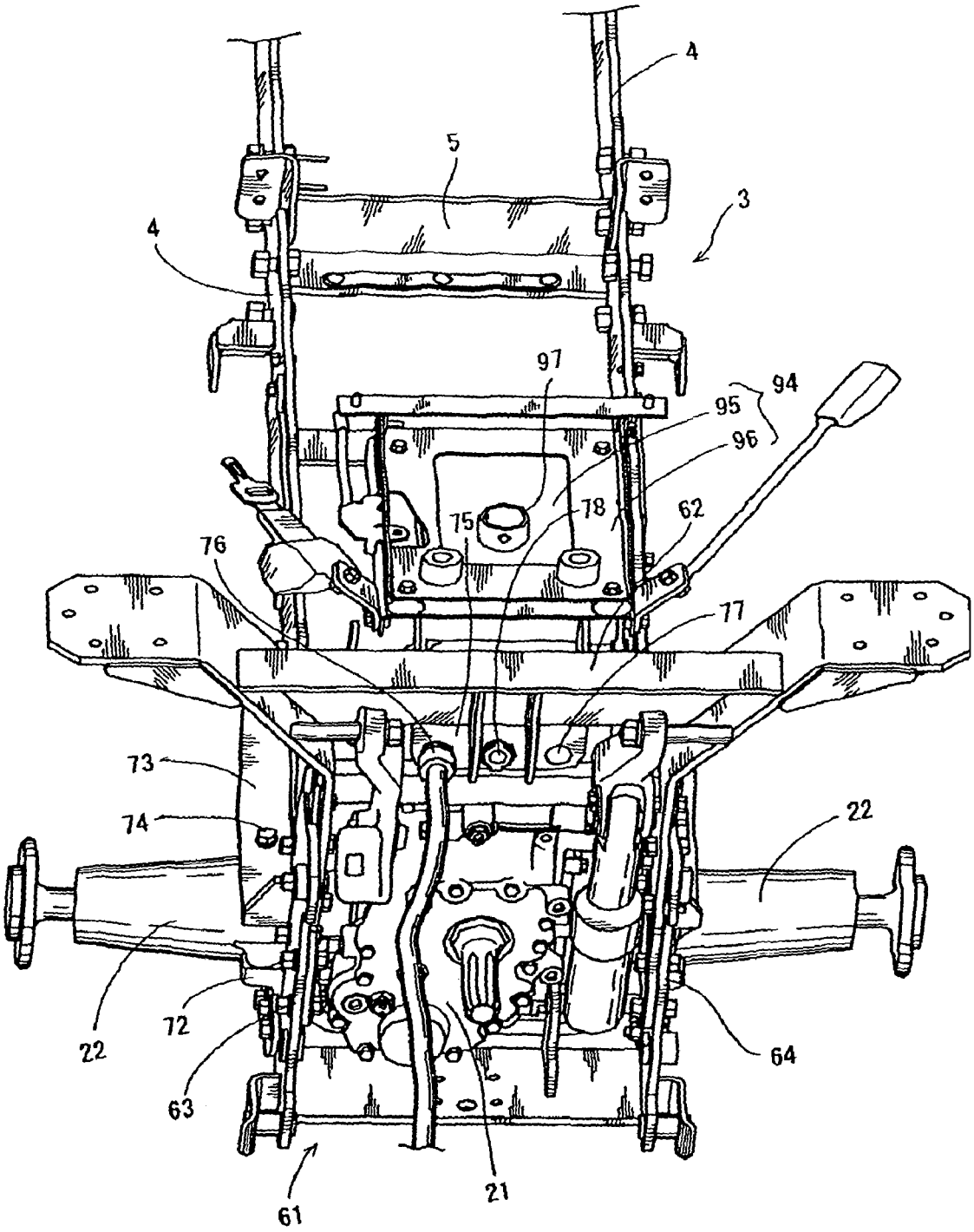
FIG. 8 is a perspective view in the case of viewing the vehicle body frame with the transmission case from a rear side.

As shown in FIGS. 7 and 8, the transmission case 21 comes close to the backhoe support frame 61 while being positioned between the right and left main frames 4. A lower surface of the transmission case 21 is supported by a base portion of the reinforcing plate 70. Each of the rear axle cases 22 protruding to the right and left outer sides from the transmission case 21 is inserted between the main frame 4 and the lower brace member 65.

Each of the support brackets 73 and the protruding end portion 72 of the right and left stepped portion 71 in the reinforcing plate 70 are so coupled that the rear axle case 22 is disposed therebetween from the upper end lower sides. In this case, as shown in FIG. 7, three elements including each of the support brackets 73, the right and left protruding end portion of the reinforcing plate 70, and the rear axle case 22 are fastened in common by a headed continuous threaded bolt 74 screwed from the upper side (at two positions per each of right and left sides, totally four positions), and it is possible to finely adjust the attaching position of the transmission case 21 and the right and left rear axle case 22 with respect to the reinforcing plate 70, on the basis of a screwing operation of each of the continuous threaded bolts 74.

In the embodiment, the transmission case 21 and the rear axle case 22 are made of an aluminum die casting, and its Young's modulus is about 130 GPa. The vehicle body frame 3, the backhoe support frame 61, each of the brace members 64 and 65, and each of the support brackets 73 are made of a structural rolled steel, and its Young's modulus is about 210 GPa. Further, the reinforcing plate 70 is made of a cast iron, and its Young's modulus is about 100 GPa.

In accordance with the structure mentioned above, since each of the support brackets 73 and the protruding end portion 72 of the right and left stepped portion 71 in the reinforcing plate 70 are so coupled that the rear axle case 22 is disposed therebetween from the upper and lower sides, the reinforcing plate 70 and both the right and left lower brace members 65 serve as the strength member supplementing the rigidity of the vehicle body frame 3, and the load generated at a time of traveling in a state in which the backhoe 41 is installed and at a time of an evacuating work by the backhoe 41 is dispersed to the reinforcing plate 70 and both the right and left lower brace members 65 in addition to the vehicle body frame 3 and the backhoe support frame 61.

Accordingly, since it is possible to improve the support strength as a whole of the traveling vehicle body 2 with respect to the transmission case 21 and the rear axle case 22, and it is possible to inhibit the load from being propagated to the cases 21 and 22, it is not necessary to thicken the cases 21 and 22 themselves, and it is possible to avoid an increase in size of the cases. As a result, it is possible to contribute to suppression of the manufacturing cost.

Particularly, in the embodiment, since three elements including each of the support brackets 73, the right and left protruding end portion of the reinforcing plate 70, and the rear axle case 22 are fastened in common by the headed continuous threaded bolt 74 screwed from the upper side (at two positions per each of right and left sides, totally four positions), and it is possible to finely adjust the attaching position of the transmission case 21 and the right and left rear axle case 22 with respect to the reinforcing plate 70 in accordance with the screwing operation of each of the continuous threaded bolt 74, it is easy to bring the reinforcing plate 70 into close contact with the lower surface of the transmission case 21, and it is possible to further improve the support strength with respect to the transmission case 21 and the rear axle case 22.

Further, since the reinforcing plate 70 most closely attached to the transmission case 21 is made of a raw material having the smallest Young's modulus, the load generated at a time of traveling in the state in which the backhoe 41 is installed and at a time of the excavating work by the backhoe 41 tends to be concentrated on the reinforcing plate 70. Accordingly, it is possible to effectively inhibit the load from being propagated to the transmission case 21 and the rear axle case 22.

In this case, as shown in FIG. 8, a working fluid feed coupler 76 and a working fluid return coupler 77 are installed as a hydraulic piping coupler to a coupler bracket 75 provided in an inner peripheral side of the upper frame portion 62 in the backhoe support frame 61.

Although not being illustrated in detail, each of both the couplers 76 and 77 is connected to the transmission case 21 serving as a working fluid tank via a hydraulic piping. Each of the couplers 76 and 77 is structured such as to be connectable to the hydraulic piping coupler existing in the base plate side of the backhoe 41, and is structured such that the working fluid within the transmission case 21 is fed to and discharged from the various cylinders 49 to 53 for actuating the backhoe 41, via each of the couplers 76 and 77.

Further, an electric wiring coupler 78 is also installed to the coupler bracket 75 of the upper frame portion 62 in the backhoe support frame 61, and can be connected to an electric piping coupler (not shown) existing in the base plate side of the backhoe 41. In accordance with this structure, in addition to the hydraulic couplers 76 and 77, since the electrical coupler 78 is arranged collectively in the coupler bracket 75 of the upper frame portion 62 in the backhoe support frame 61, it is easy to carry out an attaching and detaching work of the various couplers 75 to 77. In addition, since the coupler bracket 75 is provided in the upper frame portion 62 of the backhoe support frame 61, it is possible to contribute to an improvement of an attaching and detaching workability of the couplers 76 and 78 in this point.

(3) Support Structure of Control Seat

Next, a description will be given on the support structure of the control seat 16 with reference to FIGS. 7 to 15.

Figure 9:
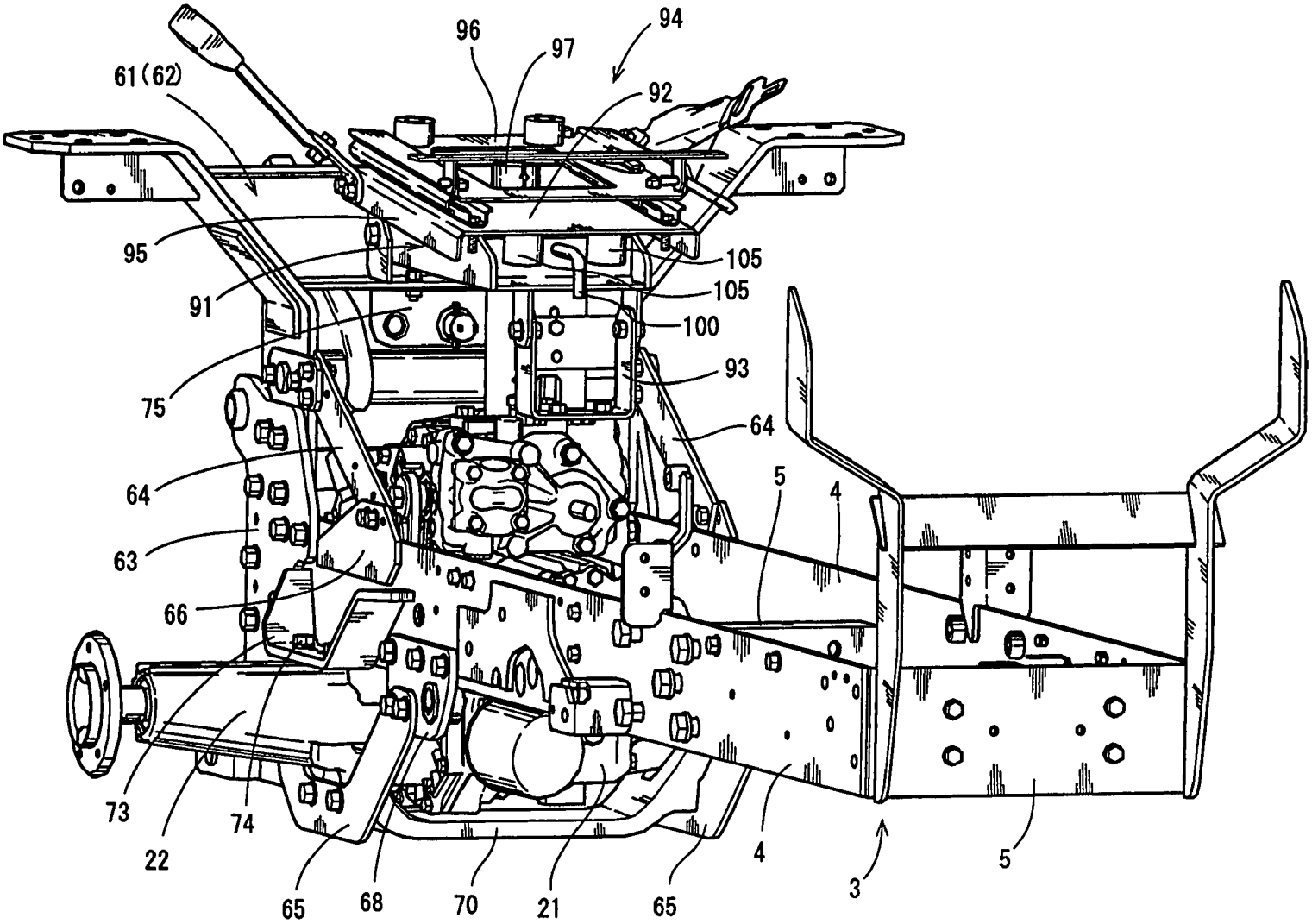
FIG. 9 is a perspective view in the case of viewing the vehicle body frame with the transmission case from a right oblique front side.
Figure 10:
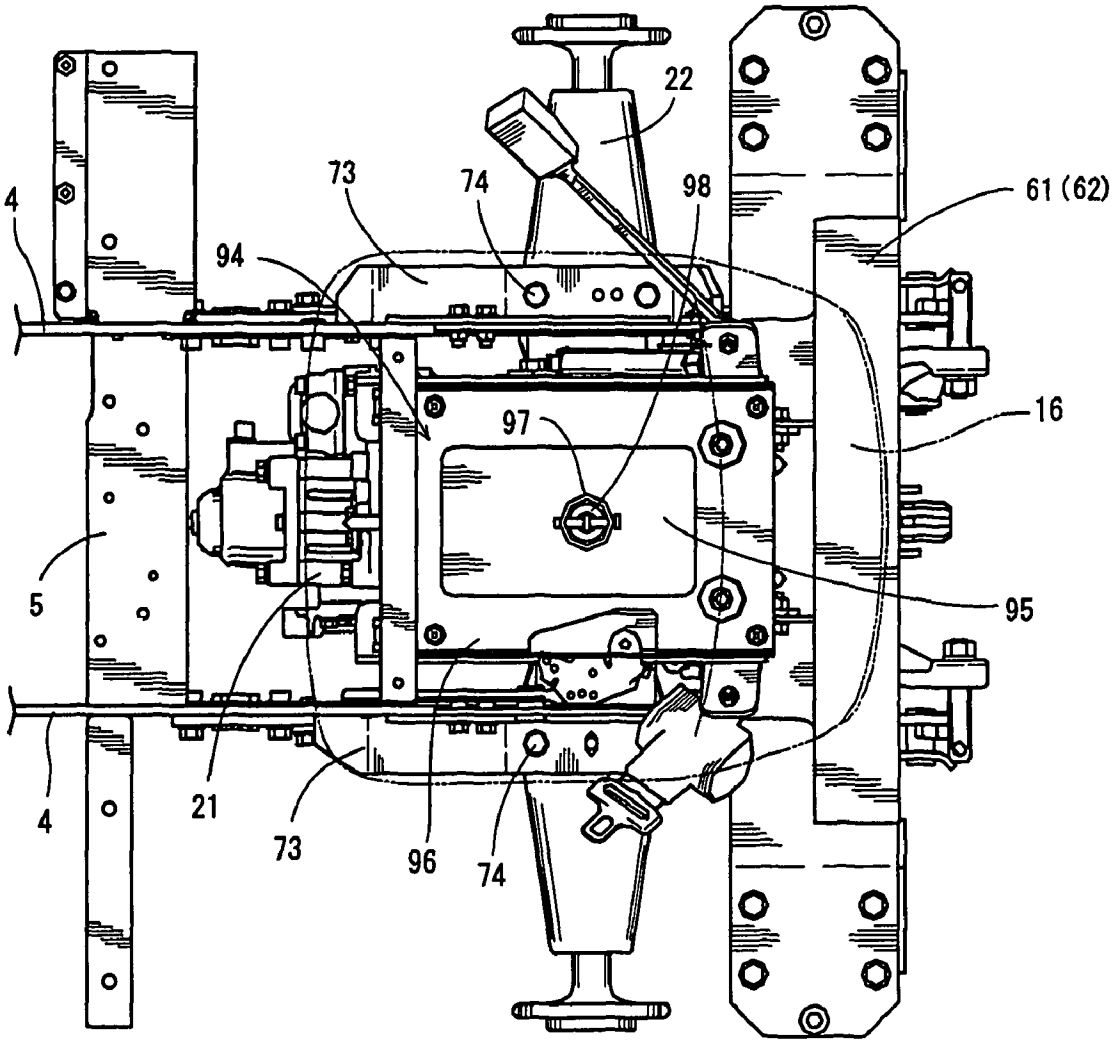
FIG. 10 is an enlarged plan view of a rear portion of the vehicle body frame at a time when a control seat is directed forward.
Figure 11:
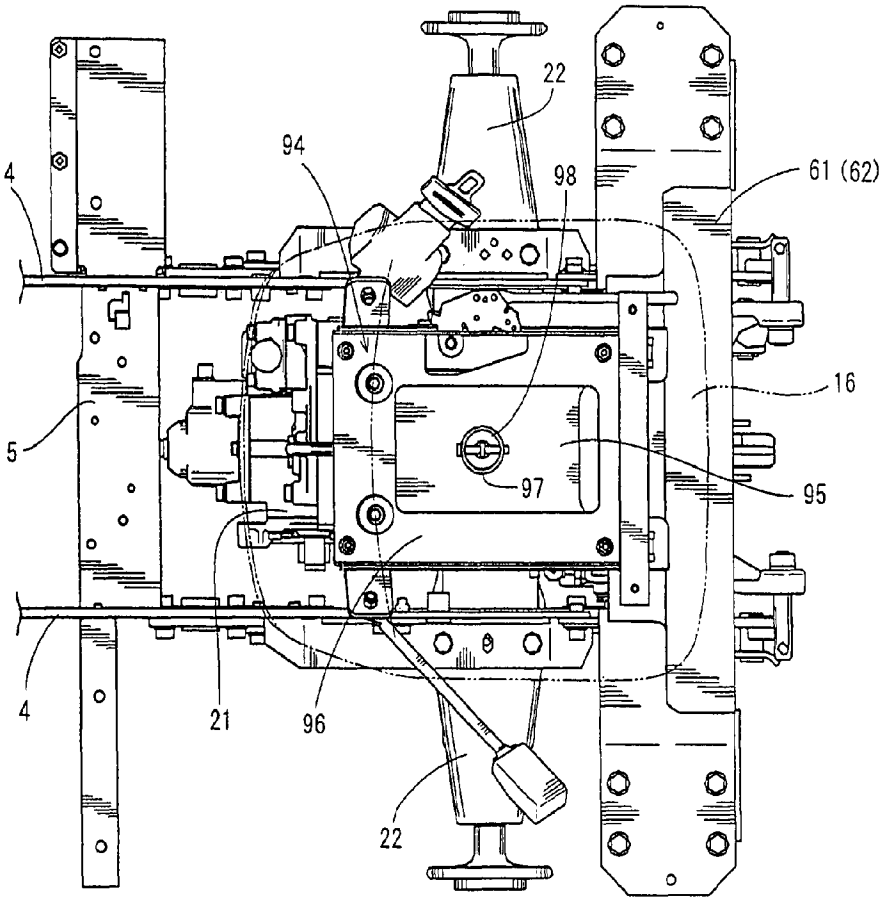
FIG. 11 is an enlarged plan view of the rear portion of the vehicle body frame at a time when the control seat is directed backward.

As shown in FIGS. 7 and 9, an attaching seat 91 of an approximately box shape in a plan view is provided in the upper surface of the transmission case 21. A front portion of the attaching seat 91 is fastened by bolts to the upper surface of the transmission case via a C-shaped arm 93, and a rear portion of the attaching seat 91 is fastened by bolts to the upper surface side of the upper frame portion 62 in the backhoe support frame 61.

An upper surface of the attaching seat 91 is provided with a seat bracket 94 supporting the control seat 16 so as to be horizontally rotatable. The seat bracket 94 is provided with a bottom support plate 95 mounted on the attaching seat 91 so as to be horizontally rotatable, and a top slide plate 96 mounted on the bottom support plate 95 so as to be slidable longitudinally, and the seat surface of the control seat 16 is attached to the top slide plate 96.

A boss tube portion 97 penetrating up and down is fixed to a center portion of the bottom support plate 95, and the seat bracket 94 and the control seat 16 can be rotated horizontally by rotatably inserting the boss tube portion 97 to an upward and downward penetrating insertion tube portion 92 provided in the attaching seat 91 (a forward and backward orientation of the control seat 16 can be changed). Further, a forward and backward position of the control seat 16 can be adjusted on the basis of a forward and backward slide of the top slide plate 96.

A seat elevating cylinder 98 for moving up and down the seat bracket 94 and the control seat 16 is provided in a lower side of the attaching seat 91 in the upper surface of the transmission case 21. The seat elevating cylinder 98 is inserted into the boss tube portion 97 of the bottom support plate 95, and a cylinder portion 98*a* thereof is fastened with a pin to an upper end of the boss tube 97 (see FIGS. 12 to 14). A piston rod 98*b* of the seat elevating cylinder 98 is coupled to an arm 99 provided in a protruding manner in the upper surface of the transmission case 21. Accordingly, since the boss tube portion 97 of the seat support plate 95 is moves so as to rise and set with respect to the insertion tube portion 92 of the attaching seat 91 in accordance with an expanding and contracting motion of the piston rod 99 in the seat elevating cylinder 98, it is possible to move up and down the seat bracket 94 and the control seat 16.

Figure 12:
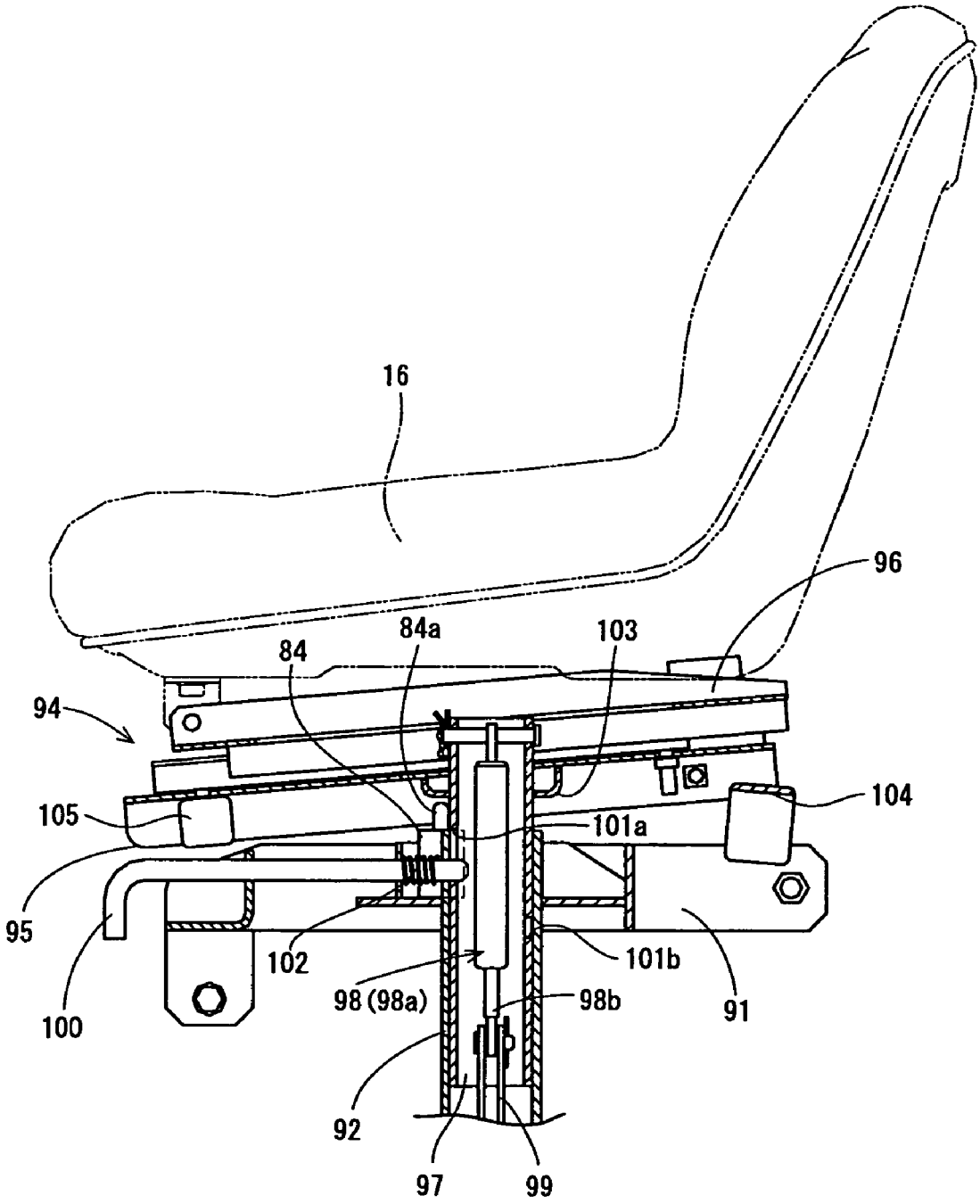
FIG. 12 is a side cross-sectional view of the control seat in a forward and non-seated state.
Figure 13:
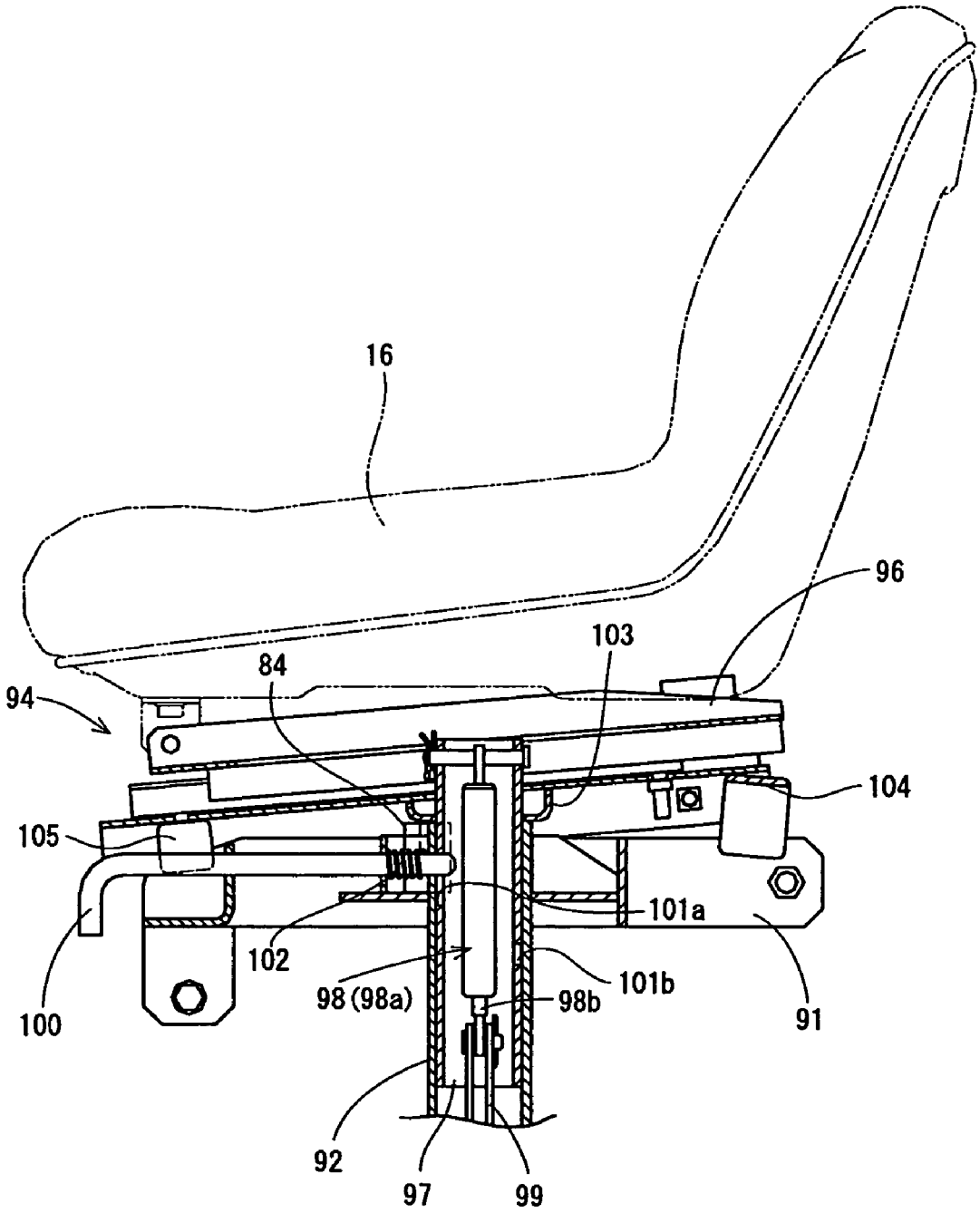
FIG. 13 is a side cross-sectional view of the control seat in a forward and seated state.
Figure 14:
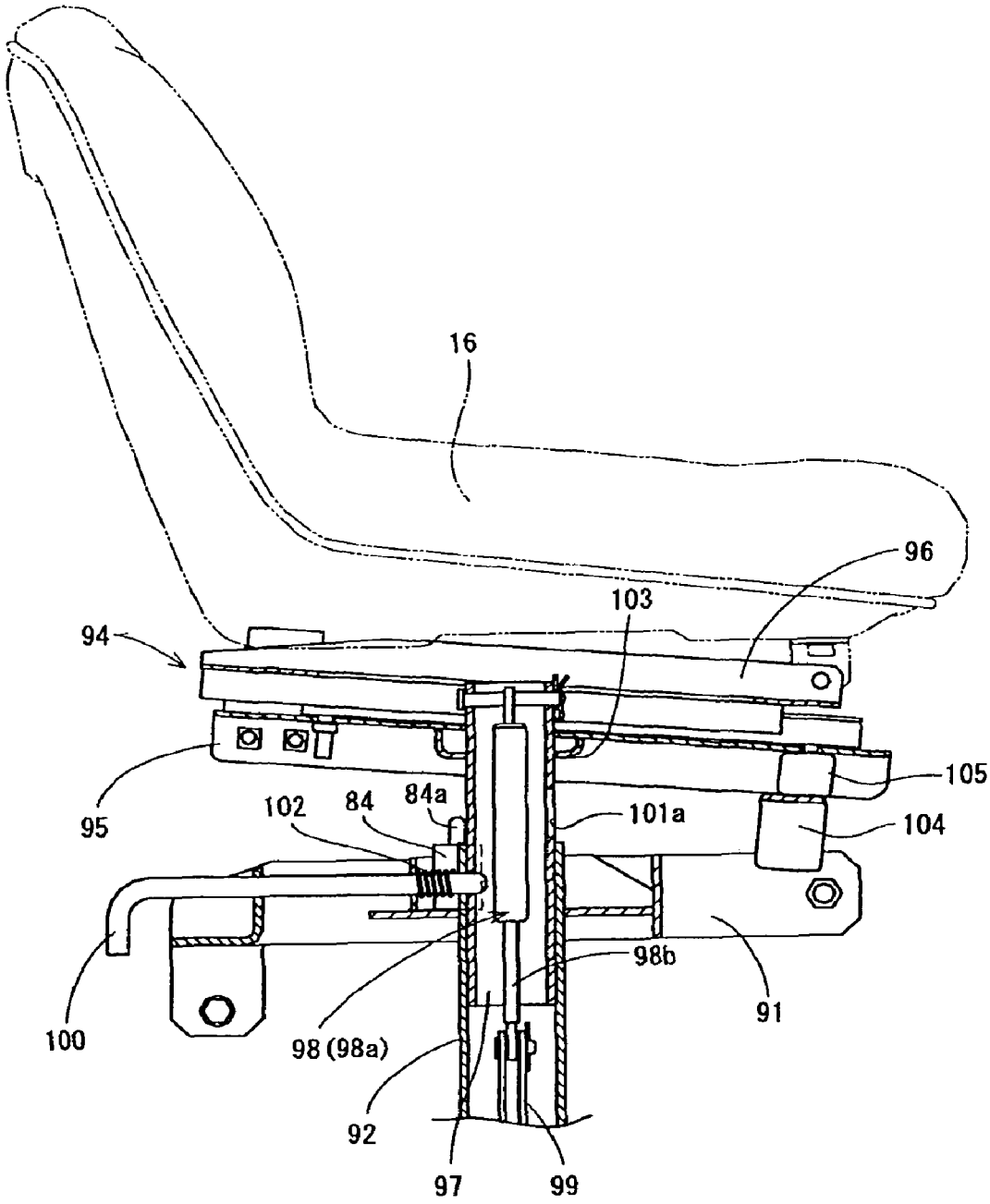
FIG. 14 is a side cross-sectional view of the control seat in a backward state.

As shown in FIGS. 12 to 14, a seating sensor 84 serving as a seating detecting means detecting the seating of the operator on the control seat 16 is provided below the control seat 16, specifically in the vicinity of the insertion tube portion 92 on the upper surface of the attaching seat 91. The seating sensor 84 is a contact type limit switch detecting whether or not the operator seats on the control seat 16 on the basis of whether or not a lower surface of a support collar 103 for receiving a bottom support plate 95 fixed to an outer periphery of a boss tube portion 97 comes into contact with a sensing body 84*a* capable of rising and setting up and down so as to make the sensing body 84*a* rise and set. The seating sensor 84 is structured as an on-off changeover switch type operating so as to turn on if the operator moves away from the control seat 16.

A front face side of the attaching seat 91 is provided with a sliding type direction fixing lever 100 which can be fitted to and detached from the boss tube portion 97 of the insertion tube portion 92 and the bottom support plate 95. The direction fixing lever 100 is structured such as to be operable so as to slide forward and backward, and the forward and backward direction of the seat bracket 94 and the control seat 16 can be fixed by fitting and detaching the leading end portion thereof to and from engagement holes 101*a* and 101*b* formed in the boss tube portion 97, in accordance with the forward and backward sliding operation of the direction fixing lever 100. The direction fixing lever 100 is always energized to a rear side (a direction in which the engagement holes 101*a* and 101*b* are fitted) by a compression spring 102 fitted to an end portion in the insertion tube portion 92 side.

The engagement hole 101*a* for forward fixing in the boss tube portion 97 is formed as a long hole which extends longitudinally. As shown in FIG. 12, in the case of directing the control seat 16 forward and fitting the leading end portion of the direction fixing lever 100 to the engagement hole 101*a* for forward fixing, if the operator does not seat on the control seat 16, the control seat 16 lifts up somewhat on the basis of the operation of the seat elevating cylinder 98.

Accordingly, if the operator does not seat on the forward control seat 16, the lower surface of the support collar 103 on the outer periphery of the boss tube portion 97 is detached upward from the sensing body 84*a* of the seating sensor 84, and the seating sensor 84 comes to the on state in which the sensing body 84*a* protrudes upward.

As shown in FIG. 13, in the state in which the operator seats on the forward control seat 16, the lower surface of the support collar 103 on the outer periphery of the boss tube portion 97 presses the sensing body 84*a* of the seating sensor 84 from the above, and the sensing sensor 84 comes to the off state in which the sensing body 84*a* sets downward.

In the case that the control seat 16 is rotated at 180 degree so as to be directed backward, the engagement of the boss tube portion 97 in the seat support plate 95 with the engagement hole 101*a* for forward fixing is canceled by pulling the direction fixing lever 100 to a near side, the seat elevating cylinder 98 is temporarily elongated, and the control seat 16 is thereafter rotated at 180 degree per the seat bracket 94 so as to be directed backward. Thereafter, the operator seats on the control seat 16, whereby the leading end portion of the direction fixing lever 100 is fitted to the engagement hole 101*b* for backward fixing of the boss tube portion 97 in the seat support plate 95 on the basis of an energizing force of the compression spring 102, and the height position of the seat bracket 94 and the control seat 16 is fixed (see FIG. 14).

The engagement hole 101*b* for backward fixing in the boss tube portion 97 is formed at a lower position than engagement hole 101*a* for forward fixing. Accordingly, as shown in FIG. 14, in the state in which the control seat 16 is directed backward and the leading end portion of the direction fixing lever 100 is fitted to the engagement hole 101*b* for backward fixing, the lower surface of the support collar 103 on the outer periphery of the boss tube portion 97 is greatly away upward from the sensing body 84*a* of the seating sensor 84, and the control seat 16 is retained at a height position at which the control seat 16 can not come into contact with the sensing body 84*a* of the seating sensor 84. Accordingly, in the case that the control seat 16 is directed backward, the seating sensor 84 always comes to the on state.

In this case, the control seat 16 may be structured such as to be moved up and down while being horizontally rotated so as to be changed in the forward and backward orientation. For example, the boss tube portion 97 of the bottom support plate 95 and the insertion tube portion 92 of the attaching seat 91 may be coupled in a screwing manner.

As shown in FIGS. 12 to 15, a C-shaped seat receiving bracket 104 is fixed to a rear portion of the attaching seat 91 by a welding or the like. Although an illustration is omitted, an elastic cover made of an elastic material, for example, a synthetic resin (rubber) is attached to an upper surface of a wide plate portion in the seat receiving bracket 104. In a state of seating on the forward-looking control seat 16, the rear portion of the lower surface of the seat support plate 95 comes into contact with the elastic cover of the seat receiving bracket 104. A friction force generated by the contact thereof prevents a rattling motion of the control seat 16 caused by an insertion gap between the insertion tube portion 92 and the boss tube portion 97.

Figure 15:
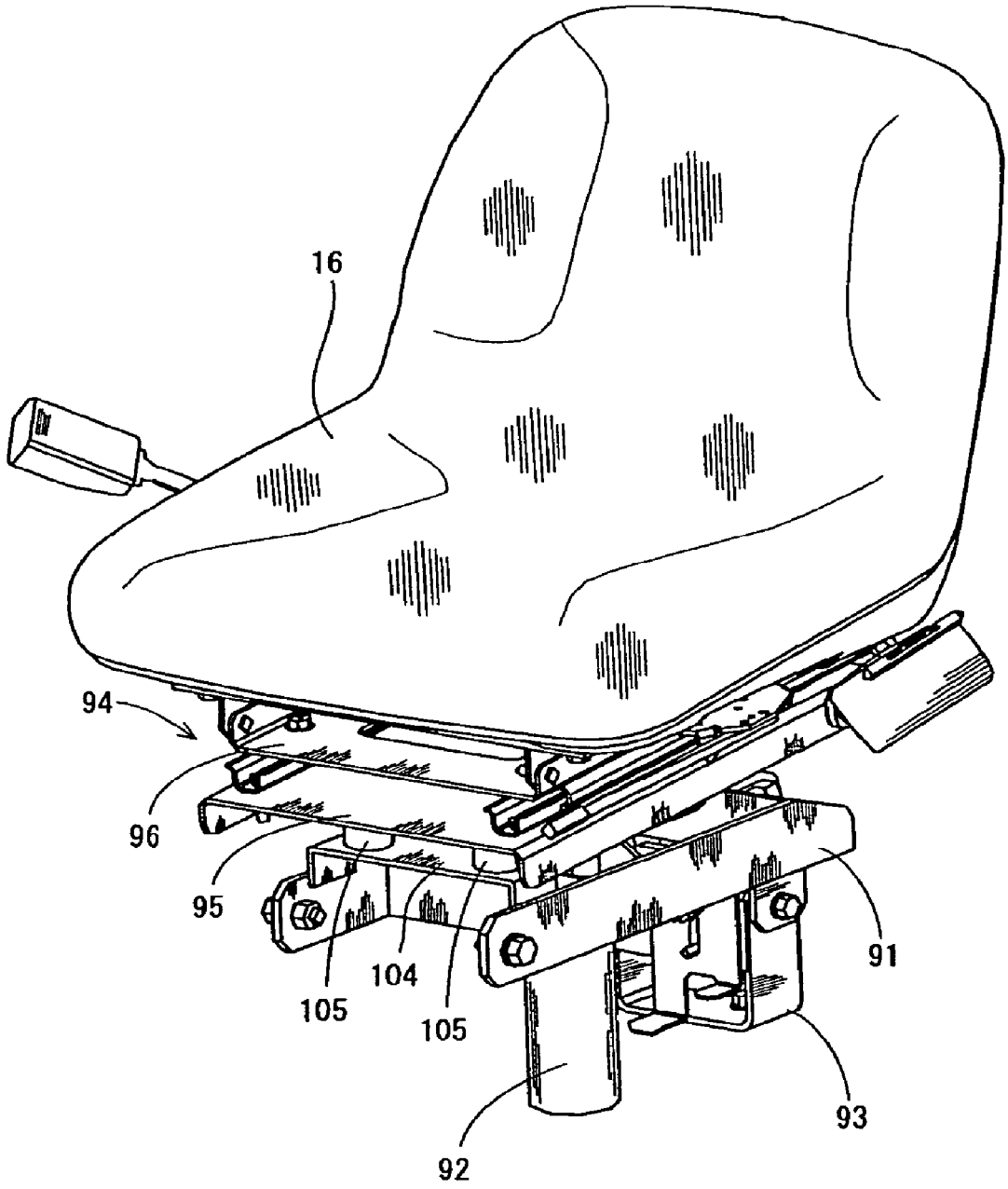
FIG. 15 is a perspective view in the case of viewing the backward-looking control seat from a right oblique rear side.

Further, a front portion of the lower surface of the seat support plate 95 is provided with a support block 105 made of an elastic material such as a synthetic resin (rubber) in a suspended state. As shown in FIGS. 14 and 15, in the case that the control seat 16 is directed backward, both the right and left support blocks 105 in the seat support plate 95 side are mounted on the elastic cover of the seat receiving bracket 104. The friction force generated by the contact thereof prevents the rattling motion of the control seat 16 caused by the insertion gap between the insertion tube portion 92 and the boss tube portion 97.

(4) Structure of Safety Mechanism

Figure 16:
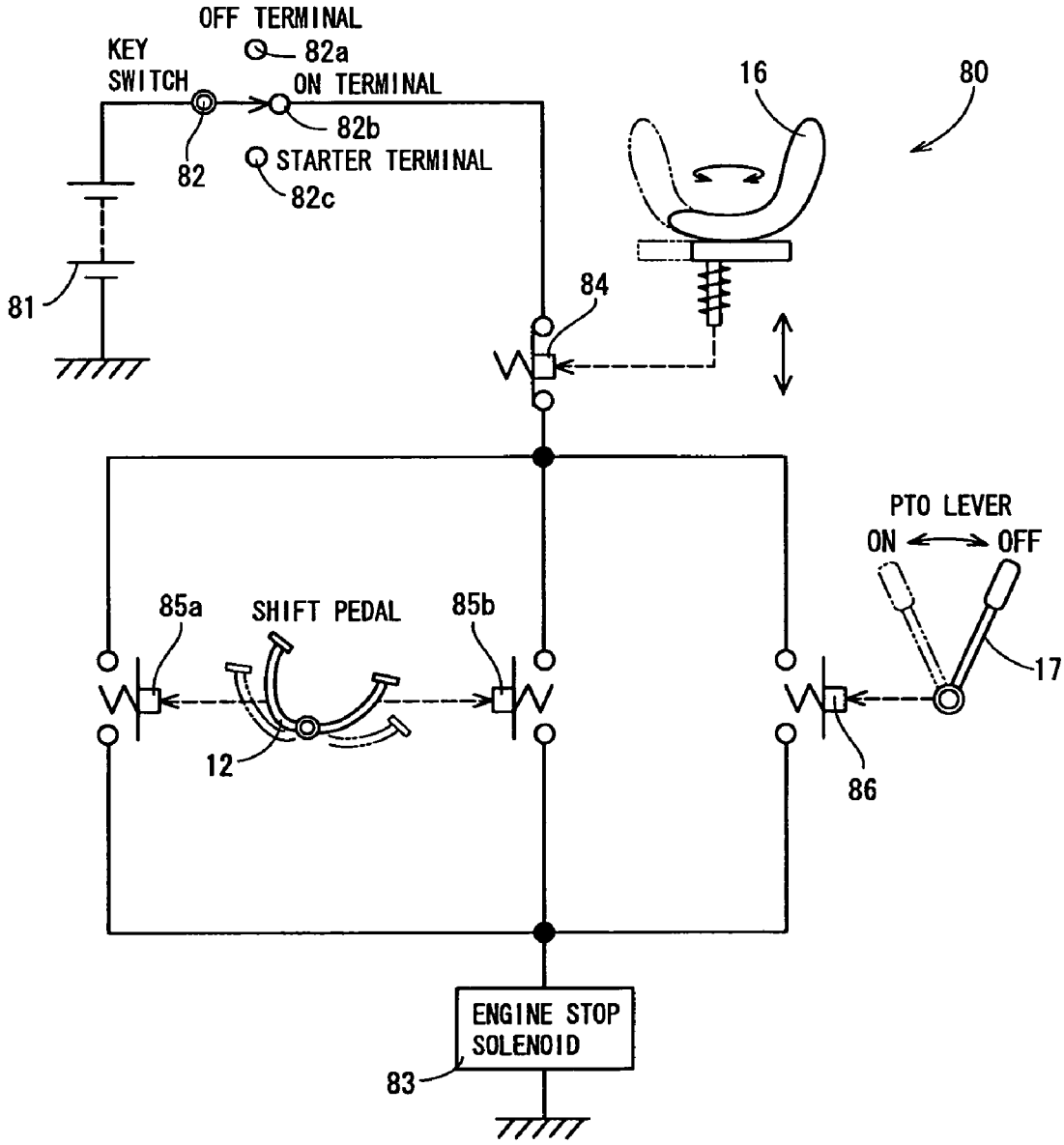
FIG. 16 is an electric circuit diagram of a safety mechanism.

Next, a description will be given of a structure of a safety mechanism 80 for preventing a careless drive of the TLB 1 mainly with reference to FIG. 16.

The safety mechanism 80 of the TLB 1 in the embodiment is provided with a battery 81, a key switch 82 for applying a power supply, and an engine stop solenoid 83 serving as an engine stop mechanism provided in association with a fuel injection pump with governor (not shown) regulating a fuel injection amount to the engine 8.

The key switch 82 in the embodiment is a rotary type switch which can switch three terminal positions including an off terminal 82*a*, an on terminal 82*b* and a starter terminal 82*c* in accordance with a rotating operation. The engine stop solenoid 83 is connected in series to the on terminal 82*b* of the key switch 82 via a seating sensor 84 serving as a seating detecting means. The fuel feed from the fuel tank (not shown) to the engine 8 is cancelled by an operation of the engine stop solenoid 83. As a result, the drive of the engine 8 is stopped. As mentioned above, the seating sensor 84 is of an on-off changeover switch type which is activated to be turned on if the operator separates from the control seat 16.

A forward movement detecting sensor 85*a* and a backward movement detecting sensor 85*b* serving as a shift control detecting body, and a PTO sensor 86 are connected in parallel between the seating sensor 84 and the engine stop solenoid 83. Accordingly, these individual sensors 85*a*, 85*b*, 86, the seating sensor 84, and the engine stop solenoid 83 are in a state in which they are connected in series.

The forward movement detecting sensor 85*a* is of an on-off changeover switch type which is activated to be turned on by a pedaling operation toward the forward moving direction in the shift pedal 12 serving as the shift control means. The backward movement detecting sensor 85*b* is of an on-off changeover switch type which is activated to be turned on by a pedaling operation toward the backward moving direction in the shift pedal 12 in the same manner. The PTO sensor 86 is of an on-off changeover switch type which is activated to be turned on by a turning on operation of the PTO lever serving as the PTO operating means.

In the case that the operator seats on the forward-looking control seat, the seating sensor 84 comes to an off state in which the sensing body 84*a* is set downward. Accordingly, the current application to the engine stop solenoid 83 remains being shut off, and the engine stop solenoid 83 is not activated. Therefore, even if the shift pedal 12 and the PTO lever 17 are operated, the drive of the engine 8 is maintained.

In the case that the operator erroneously operates the shift pedal 12 in the forward or backward moving direction in a state in which the operator does not seat on the forward-looking control seat 16, the seating sensor 84 comes to an on state in which the sensing body 84*a* is protruded upward, and either the forward movement detecting sensor 85*a* or the backward movement detecting sensor 85*b* comes to the on state. Accordingly, the engine stop solenoid 83 is activated on the basis of the current application from the battery 81, and the drive of the engine 8 is automatically stopped. In other words, in the case that the operator erroneously operates the shift pedal 12 without seating on the forward-looking control seat 16, the drive of the TLB 1 is inhibited.

In the case that the operator turns on the PTO lever 17 in a state in which the operator does not seat on the forward-looking control seat 16, the seating sensor 84 and the PTO sensor 86 come to an on state. Accordingly, the engine stop solenoid 83 is activated on the basis of the current application from the battery 81, and the drive of the engine 8 is automatically stopped. In other words, even in the case that the operator turns on the PTO lever 17 without seating on the forward-looking control seat 16, the drive of the TLB 1 is inhibited.

On the other hand, in the case that the control seat 16 is rotated at 180 degree so as to be directed backward, the control seat 16 is retained at the height position at which the control seat 16 can come into contact with the sensing body 84*a* as mentioned above, and the seating sensor 84 always comes to the on state. Accordingly, the same operation as the case that the operator does not seat on the forward-looking control seat 16 is executed.

In other words, in the case that the shift pedal 12 is erroneously activated or the PTO lever 17 is turned on in a state in which the control seat 16 is set to the backward direction, the engine stop solenoid 83 is activated on the basis of the current application from the battery 81, the drive of the engine 8 is automatically stopped, and the drive of the TLB 1 is inhibited.

As is apparent from the structure mentioned above, in accordance with the present invention, since the seating sensor 84 is retained in the on state at a time of the excavating work by the backhoe 41 which is carried out by setting the control seat 16 to the backward direction, it is possible to forcibly stop the engine 8 in the case that the shift pedal 12 is erroneously activated in the state in which the operator does not seat on the forward-looking control seat 16, in spite that the seating sensor 84 is only provided as the means for detecting the state of the control seat 16. Further, it is possible to forcibly stop the engine 8 at a time of erroneously operating the shift pedal 12 in the state in which the control seat 16 is directed backward, while maintaining the basic function mentioned above. Accordingly, it is possible to securely prevent a risk that the TLB 1 begins to run carelessly at a time of the excavating work by the backhoe 41, and it is possible to achieve an effect that a safety is improved.

Further, since the seating sensor 84 is only provided as the means for detecting the state of the control seat 16, and the means for detecting the forward and backward directions of the control seat 16 is not necessary, it is possible to suppress a parts cost, and it is possible to simplify the electric system such as the electric circuit, the harness or the like. Accordingly, it is possible to achieve an effect that the reduction of the manufacturing cost can be obtained.

Further, since the engine stop solenoid 83 is activated at a time of turning on the PTO lever 17 in the case that the seating sensor 84 is in the on state, it is possible to forcibly stop the engine 8 even at a time of turning on the PTO lever 17 in the state in which the operator does not seat on the forward-looking control seat 16, or at a time of turning on the PTO lever 17 in the state in which the control seat 16 is directed backward. Therefore, it is possible to securely prevent a risk that the mower device 25 carelessly drives at a time of the excavating work by the backhoe 41, and it is possible to provide the TLB 1 having a higher safety.

Further, since the seating sensor 84 is the contact type limit switch arranged below the control seat 16, and the control seat 16 is structured such as to be retained at the height position at which the control seat 16 can not come into contact with the seating sensor 84 in the backward-looking state, it is possible to simply set the seating sensor 84 to the on state at a time of the excavating work by the backhoe 41, on the basis of the simple structure which retains the backward-looking control seat 16 at the high position so as to prevent the control seat 16 from coming into contact with the seating sensor 84. Accordingly, it is possible to achieve an effect of further reduction of the manufacturing cost in spite of the TLB 1 obtained taking the safety into consideration.

In this case, it is possible to employ a structure for invalidating a pedaling operation of the shift pedal 12 by automatically turning on the parking brake mechanism retaining the braked state of both the right and left wheels 7 on the basis of the on operation of the parking brake lever 14 in accordance with the driving of an actuator such as an electric motor or the like, in a case that the operator is seated on the backward-looking control seat 16, the structure not being illustrated in detail. Further, it is possible to employ a structure for automatically turning off the PTO clutch maintaining and interrupting the power transmission from the transmission case 21 to the mower device 25 on the basis of the driving of the actuator such as the electric motor or the like, in the case that the operator seats on the backward-looking control seat 16. Both of them take into consideration of the safety at a time of the excavating work by the backhoe 41.

(5) Other

The present invention is not limited to the embodiment mentioned above, but can be embodied into various aspects. For example, the present invention is not limited to the TLB, but can be applied to a tractor which does not have the front loader but is provided only with the backhoe. In addition, the structure of each of the portions is not limited to the illustrated embodiment, but can be variously modified within the scope of the present invention.

What is claimed is:

1. A working vehicle comprising:

an engine mounted on a front portion of a vehicle body frame constructing a traveling vehicle body;

a backhoe mounted on a rear portion of the vehicle body frame;

a seating detecting means detecting a seating of an operator in a control seat on the traveling vehicle body;

an engine stop mechanism stopping the engine; and a shift operating means for controlling so as to increase and decrease forward and backward moving speeds of the traveling vehicle body, wherein the engine stop mechanism is actuated at a time of operating the shift control means in the case that the seating detecting means is in an on state, and the seating detecting means is retained to the on state regardless of the seating of an operator in the case that the control seat is directed backward.

2. The working vehicle according to claim 1, further comprising:

a mower device arranged below the vehicle body frame; and a PTO operating means for operating an on and off of a power transmission to the mower device, wherein the engine stop mechanism is activated at a time of turning on the PTO operating means in the case that that the seating detecting means is in an on state.

3. The working vehicle according to claim 1 or 2, wherein the seating detecting means is a contact type limit switch arranged below the control seat, and the control seat is structured such as to be retained at a height position which is not allowed to come into contact with the seating detecting means in a backward-looking state.

* * * * *